US009725206B2

(12) United States Patent
Linssen

(10) Patent No.: US 9,725,206 B2
(45) Date of Patent: Aug. 8, 2017

(54) PACKAGE AS WELL AS A SLIDE AND A HOUSING SUITABLE FOR SUCH A PACKAGE

(71) Applicant: ECOBLISS HOLDING B.V., Echt (NL)

(72) Inventor: Ronaldus Josephus Marie Linssen, Echt (NL)

(73) Assignee: ECOBLISS HOLDING B.V., Echt (NL)

( * ) Notice: Subject to any disclaimer, the term of this patent is extended or adjusted under 35 U.S.C. 154(b) by 0 days.

(21) Appl. No.: 14/899,557

(22) PCT Filed: Jul. 1, 2014

(86) PCT No.: PCT/EP2014/063956

§ 371 (c)(1),
(2) Date: Dec. 18, 2015

(87) PCT Pub. No.: WO2015/000896

PCT Pub. Date: Jan. 8, 2015

(65) Prior Publication Data

US 2016/0152373 A1 Jun. 2, 2016

(30) Foreign Application Priority Data

Jul. 4, 2013 (NL) ..... 2011090

(51) Int. Cl.
*B65D 5/38* (2006.01)
*B65D 77/04* (2006.01)
*B65D 83/04* (2006.01)

(52) U.S. Cl.
CPC ..... *B65D 5/38* (2013.01); *B65D 77/0433* (2013.01); *B65D 83/0472* (2013.01); *B65D 2215/02* (2013.01)

(58) Field of Classification Search
CPC ..... A45C 13/12; B65D 5/38; B65D 77/04; B65D 77/0433; B65D 83/04; B65D 83/0472; B65D 2215/02
(Continued)

(56) References Cited

U.S. PATENT DOCUMENTS 3,942,630 A * 3/1976 Phillips ..... B65D 43/12 206/1.5
4,126,224 A * 11/1978 Laauwe ..... B65D 50/06 206/1.5

(Continued)

FOREIGN PATENT DOCUMENTS

EP 0053593 A1 6/1982
EP 0882457 A2 12/1998

(Continued)

OTHER PUBLICATIONS

ISR for PCT/EP2014/063956 mailed on Sep. 24, 2014.

(Continued)

*Primary Examiner* — Bryon Gehman
(74) *Attorney, Agent, or Firm* — Ladas & Parry, LLP

(57) ABSTRACT

A package (1, 101, 201, 301, 401) comprises a housing (2, 102, 202) and a slide (3, 103, 203) which is slidably accommodated in the housing in a sliding direction (PI). The slide comprises a bottom wall (17), side walls (18-21) connected to the bottom wall as well as at least one flange-shaped upper edge (22) spaced from the bottom wall, which is connected to the side walls. The housing is provided with at least one recess (14, 15), in which at least one projection connected to the slide can be positioned for at least locking the slide in position in the housing. The projection can be moved out of the recess against spring force, after which the slide can be moved in the sliding direction in the housing. The flange-shaped upper edge comprises two parts that extend parallel to the sliding direction, wherein each part is (Continued)

provided with at least one hook-shaped element (27, 327), while the housing comprises two side walls (5, 6), wherein each side wall is provided with at least one recess, wherein a recess and a hook-shaped element located at a first side wall are staggered, seen in the sliding direction, relative to a recess and a hook-shaped element located at a second side wall. The hook-shaped elements of the flange-shaped upper edge can be moved out of the recesses against the spring force of the flange-shaped upper edge.

15 Claims, 14 Drawing Sheets

(58) Field of Classification Search
USPC ..... 206/1.5; 220/345.1–345.5; 229/125.125
See application file for complete search history.

(56) References Cited

U.S. PATENT DOCUMENTS

| | | | | |
|---|---|---|---|---|
| 4,284,204 | A * | 8/1981 | Carey, Jr. ..... | B65D 11/12 206/1.5 |
| 5,788,079 | A | 8/1998 | Bouthiette | |
| 7,188,729 | B2 | 3/2007 | DeJonge | |
| 7,661,534 | B2 | 2/2010 | Saclier et al. | |
| 7,798,329 | B2 * | 9/2010 | Gelardi ..... | B65D 83/0463 206/1.5 |
| 7,854,325 | B2 | 12/2010 | Bentele | |
| 8,220,636 | B2 | 7/2012 | Beecroft | |
| 8,991,606 | B2 | 3/2015 | Ortenzi | |
| 9,174,780 | B2 | 11/2015 | Gelardi | |
| 9,278,792 | B2 | 3/2016 | Linssen | |
| 2006/0157375 | A1 | 7/2006 | DeJonge | |
| 2007/0261984 | A1 | 11/2007 | Gelardi | |
| 2008/0283434 | A1 * | 11/2008 | Gelardi ..... | B65D 83/0463 206/1.5 |
| 2009/0255842 | A1 | 10/2009 | Brozell et al. | |
| 2010/0252478 | A1 | 10/2010 | Beecroft | |
| 2010/0264054 | A1 | 10/2010 | Beecroft | |
| 2011/0108451 | A1 | 5/2011 | Sack et al. | |
| 2011/0127320 | A1 | 6/2011 | Sams | |
| 2011/0226765 | A1 | 9/2011 | Gelardi | |
| 2012/0012497 | A1 | 1/2012 | Weston | |
| 2012/0234701 | A1 | 9/2012 | Albrecht | |

FOREIGN PATENT DOCUMENTS

| | | |
|---|---|---|
| JP | S56125816 U | 9/1981 |
| JP | H0958748 A | 3/1997 |
| JP | 2011121625 A | 6/2011 |
| WO | 2005/068304 | 7/2005 |
| WO | 2008/061026 | 5/2008 |
| WO | 2013/070506 | 5/2013 |
| WO | 2013/151806 | 10/2013 |
| WO | 2015/000896 | 1/2015 |

OTHER PUBLICATIONS

Written Opinion for PCT/EP2014/063956 mailed on Sep. 24, 2014.
IPRP for corresponding PCT/EP2014/063956 dated Jan. 5, 2016.
EPO Communication under Rule 71(3) EPC dated Nov. 16, 2016 from European Patent Application No. EPO 14736717.1 (41 pages).
EPO Extended Search Report from European Patent Application No. 15175627.7 mailed on Nov. 18, 2015.
From U.S. Appl. No. 14/449,127 (now published as U.S. Pat. No. 9,278,792), Notice of Allowance mailed on Feb. 3, 2016.
From U.S. Appl. No. 14/449,127 (now published as U.S. Pat. No. 9,278,792), Notice of Allowance mailed on Nov. 24, 2015.
From U.S. Appl. No. 14/449,127 (now published as U.S. Pat. No. 9,278,792), Office Action mailed on Aug. 13, 2015.

* cited by examiner

PACKAGE AS WELL AS A SLIDE AND A HOUSING SUITABLE FOR SUCH A PACKAGE

CROSS-REFERENCE TO RELATED APPLICATIONS

This application is the U.S. National Stage of International Patent Application No. PCT/EP2014/063956 filed on Jul. 1, 2014, which claims priority to and the benefit of Netherlands Patent Application 2011090 filed on Jul. 4, 2013, the disclosures of which are hereby incorporated by reference in their entireties.

The invention relates to a package comprising a housing and a slide which is slidably accommodated in the housing in a sliding direction, which slide comprises a bottom wall, side walls connected to the bottom wall as well as at least one flange-shaped upper edge spaced from the bottom wall, which is connected to the side walls, which housing is provided with at least one recess, in which at least one projection connected to the slide can be positioned for at least locking the slide in position in the housing, which projection can be moved out of the recess against spring force, after which the slide can be moved in the sliding direction in the housing.

The invention also relates to a slide and to a housing suitable for such a package.

Such a package, which is known from U.S. Pat. No. 7,854,325 B2, is suitable for use as a childproof, senior-friendly package. To open the package, a user must move the projection out of the recess against spring force by pressing on the housing and subsequently pull the slide out of the housing in the sliding direction. Such combined movements are virtually impossible to carry out for a relatively young child, so that it is prevented from gaining access to products present in the slide, such as medicines, for example. For an older user, on the other hand, said movements are relatively easy to carry out, so that the older user can move the slide out of the housing in order to gain access to products present in the slide.

With the package known from U.S. Pat. No. 7,854,325 B2, a bottom side of the housing is provided with a number of guides which are provided with recesses at ends thereof. The slide is provided with projections on the bottom wall, which projections are positioned in the recesses and which are movable in the guides.

The slide is provided with separate spring elements, by means of which the projections are pressed into the recesses.

The space required for the projections, recesses and guides undesirably adds to the height of the package. In addition, producing a slide which is provided with projections as well as with spring elements and producing a housing provided with relatively complex guides is relatively costly.

The object of the invention is to provide a package which is childproof and senior-friendly and which is relatively easy to produce.

This object is achieved with the package according to the invention in that the flange-shaped upper edge comprises two parts that extend parallel to the sliding direction, wherein each part is provided with at least one hook-shaped element, whilst the housing comprises two side walls, wherein each side wall is provided with at least one recess, wherein a recess and a hook-shaped element located at a first side wall are staggered, seen in the sliding direction, relative to a recess and a hook-shaped element located at a second side wall, wherein the hook-shaped elements of the flange-shaped upper edge can be moved out of the recesses against the spring force of the flange-shaped upper edge.

Because the part of the flange-shaped upper edge that extends parallel to the sliding direction is provided with the hook-shaped element and can also be moved out of the recess against the spring force of the flange-shaped upper edge, separate projections and spring elements are not needed. As a result, the slide is relatively easy to produce. The hook-shaped element can be moved into engagement with the recess located in the side wall of the housing under the spring force of the flange-shaped upper edge. Said recess can be formed in the housing in a simple manner, for example by punching. Once the hook-shaped element has been moved out of the recess against spring force, the slide can be moved in the sliding direction, with the hook-shaped element simply sliding along the inner side of the housing.

When the slide is pulled at, without the hook-shaped elements being pressed out of the recesses, the hook-shaped elements will prevent the slide from being moved out of the housing.

The provision of a hook-shaped element that can be positioned in a recess on either side of the package makes it difficult for a child to open the package, because both hook-shaped elements must be removed from the respective recesses simultaneously before the slide can be moved in the sliding direction.

Moreover, because the hook-shaped elements are staggered, it will be virtually impossible for a young child of about 4 years old to place its fingers so that both staggered hook-shaped elements are removed simultaneously, against spring force, from the likewise staggered recesses.

According to European and US legislation, a package may be called childproof if it meets the EN/ISO 8317 standard and the US 16 CRF 1700.20 standard, respectively. Both standards prescribe extensive testing both with seniors (50-70 years old) and with children aged about 4 years. The tests are carried out by certified (ISO 17025) test agencies. It has been found that the package according to the invention is able to meet the prevailing standards.

It is noted that from JP 09058748A there is known a package comprising a housing provided with opposing recesses and a slide with opposing projections. When the slide is being moved out of the housing, the projections slip into the recesses, so that the slide is prevented from falling out of the housing in a simple manner. The projections need not be depressed for moving the slide partially out of the housing. With the package according to the present invention, the hook-shaped elements must first be depressed before the slide can be moved partially out of the housing.

One embodiment of the package according to the invention is characterised in that a diagonal line between the staggered recesses in the two side walls includes an angle of at most 60 degrees with the side wall.

The smaller the angle between the diagonal line and the side wall provided with the recess, the more difficult it will be to open the package. With a package of a particular width, the diagonal distance between the staggered recesses and the hook-shaped elements positioned therein will be larger in the case of a smaller angle than in the case of a larger angle. If the angle is too small, it will be difficult for adults, and certainly also for seniors, to open the package. Consequently, the angle is preferably larger than 20 degrees.

Another embodiment of the package according to the invention is characterised in that the staggered recesses in the two side walls are spaced a distance of at least 60 mm apart, seen in a direction parallel to the side wall.

The greater the distance, the more difficult it will be to open the package. If the distance is too great, it will be difficult for adults, and certainly also for seniors, to open the package. Consequently, the distance is preferably less than 120 mm.

Another embodiment of the package according to the invention is characterised in that the hook-shaped element has a barb-like configuration.

The barb-like configuration makes it impossible to depress the hook-shaped element whilst the slide is being pulled at. This makes it impossible to pull at the slide and subsequently depress the hook-shaped elements one by one and remove them from the recesses. The barb-like configuration forces the user to depress both hook-shaped elements simultaneously.

Another embodiment of the package according to the invention is characterised in that the recess provided in the first side wall is staggered relative to two recesses provided in the second side wall, whilst the slide is provided with three hook-shaped elements that can be moved out of the three recesses simultaneously against the spring force of the flange-shaped upper edge.

The fact that three hook-shaped elements must be depressed simultaneously makes it even more difficult to open the package.

Products such as medicines can be easily stored in the slide. The medicines, such as tablets, for example, may be packed in a blister pack, for example, a number of which blister packs are present in the slide.

Another embodiment of the package according to the invention is characterised in that the hook-shaped element lies in the same plane as the part of the flange-shaped upper edge that extends parallel to the sliding direction.

Such a hook-shaped element is easy to form in the flange-shaped upper edge, for example by punching. The hook-shaped element will in that case have the same relatively small thickness as the flange-shaped upper edge. In this way the recess present in the housing can likewise have a relatively small dimension in the thickness direction of the hook-shaped element. As a result, the strength of the housing will remain practically unchanged in spite of the presence of the recess therein.

Another embodiment of the package according to the invention is characterised in that the side wall of the housing is provided with at least two spaced-apart recesses.

In a first position, in which the slide is fully accommodated within the housing, the hook-shaped element is positioned in a first recess. In a second position, in which the slide is partially moved out of the housing, the hook-shaped element is positioned in a second recess. In this way the slide is prevented from being moved completely out of the housing in a simple manner, so that moving back the slide into the housing will be relatively easy. In addition, this makes it impossible for a user to move the slide into another housing, which might involve the risk that the information stated on the housing would no longer correspond to the medicines present in the slide.

Another embodiment of the package according to the invention is characterised in that the at least one recess is partially located in an upper wall of the housing.

The hook-shaped element only engages the side wall. Because the recess also extends over the upper wall, a user can simply place his finger against the hook-shaped element and move it away from the side wall against spring force, out of engagement with the side wall.

Another embodiment of the package according to the invention is characterised in that the housing comprises an upper wall which is provided with an opening at a front side, seen in the sliding direction, via which opening access can be gained to a part of the flange-shaped upper edge that extends transversely to the sliding direction.

Through the opening, a user can easily take hold of the part of the flange-shaped upper edge that extends transversely to the sliding direction after the hook-shaped element has been moved out of engagement with the recess in order to pull the slide out of the housing in the sliding direction.

Another embodiment of the package according to the invention is characterised in that the housing is provided with a closable flap.

The flap makes it extra difficult to gain access to the slide. The flap must first be opened before the slide can be moved out of the housing. In the closed position of the flap, the flap protects the slide and the products present therein from the ingress of dust and the like.

Another embodiment of the package according to the invention is characterised in that the housing is closed at a rear side, seen in the sliding direction.

The closed rear side makes it extra difficult to gain access to the slide.

Another embodiment of the package according to the invention is characterised in that the slide is made of plastic material, using a thermoforming process.

This is a relatively inexpensive manner of producing the slide. When a thermoforming process is used, the flange-shaped upper edge must be punched to the desired dimensions after the forming of the slide. During this usual punching operation, the hook-shaped element is simultaneously formed on the flange-shaped upper edge by means of a punching operation. As a result, additional operations for providing the slide with the hook-shaped elements are not needed.

Another embodiment of the package according to the invention is characterised in that the housing is made of cardboard.

Such a cardboard housing is usually punched from a blank. During this usual punching operation, the recess in the side wall, and possibly the upper wall, is simultaneously formed by punching. As a result, additional operations for providing the housing with the recess are not needed.

The invention will now be explained in more detail with reference to the drawings, in which.

Like parts are indicated by the same numerals in the figures.

Figure 1:
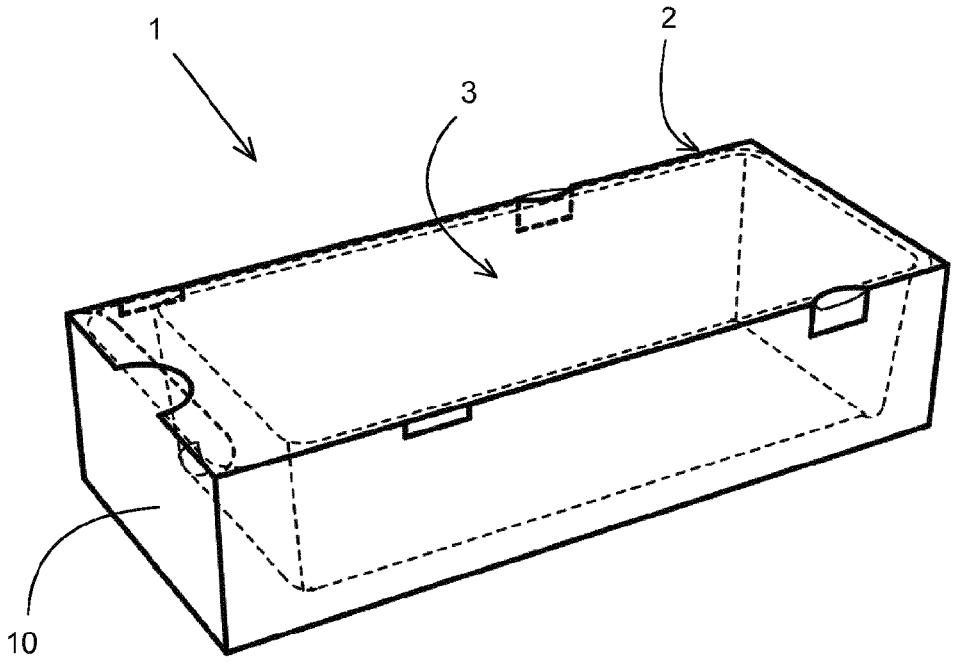
FIG. 1 is a perspective view of a first embodiment of a package according to the invention in a fully closed position.

FIGS. 1-6 show various views of a first embodiment of a package 1 according to the invention. The package comprises a cardboard housing 2 and a slide 3 of plastic material, which is slidably accommodated, in the direction indicated by arrow P1, in the housing 2. The housing 2 comprises a bottom side 4, side walls 5, 6 extending transversely to the bottom side 4, a rear wall 7 extending transversely to the bottom side 4 and the side walls 5, 6, an upper wall 8 extending parallel to the bottom side, and a flap 10 which is pivotally connected about a pivot line 9 to the bottom side. The flap 10 is provided with a flap portion 12 which is pivotable about a pivot line 11, which flap portion 12 can be positioned to abut against the upper wall 8 on an inner side. Such a rectangular housing 2 is known per se and will not be discussed in more detail herein, therefore.

On a side remote from the rear wall 7, the upper wall 8 of the housing 2 is provided with a semicircular opening 13.

The housing 2 is provided with two pairs of recesses 14, 15, which extend through the side of the side walls 4, 5 that faces the upper wall 8 and the sides of the upper wall 8 that face the side walls 4, 5. The part of the recesses 14, 15 that is provided in the side walls 4, 5 is rectangular in shape. The part of the recesses 14, 15 that is provided in the upper wall 8 is arcuate in shape. The recesses 14 are located relatively close to the rear wall 7, whilst the recesses 15 are located relatively close to the flap 10. The recesses 14, 15 of the first side wall 5 are staggered relative to the recesses 14, 15 of the second side wall 6 in the sliding direction indicated by the arrow P1.

The slide 3 comprises a bottom wall 17 and side walls 18, 19, 20, 21 extending along the circumference of the bottom wall 17, which each include an angle slightly greater than 90 degrees with the bottom wall 17. The slide 3 further comprises a flange-shaped, endless upper edge 22, spaced from the bottom wall 17, which is connected to the side walls 18, 19, 20, 21. The upper edge 22 comprises two parts 23, 24 extending parallel to the sliding direction indicated by the arrow P1, as well as two parts 25, 26 extending transversely to the sliding direction indicated by the arrow P1. The part 25 is wider than the part 26.

The parts 23, 24 each comprise a hook-shaped element 27, spaced from the wider part 25. The hook-shaped elements 27 are staggered in the sliding direction indicated by the arrow P1, similarly to the recesses 14, 15 of the housing 2. In a direction transversely to the bottom wall 17, the hook-shaped element 27 has the same thickness as the upper edge 22.

Figure 4A:
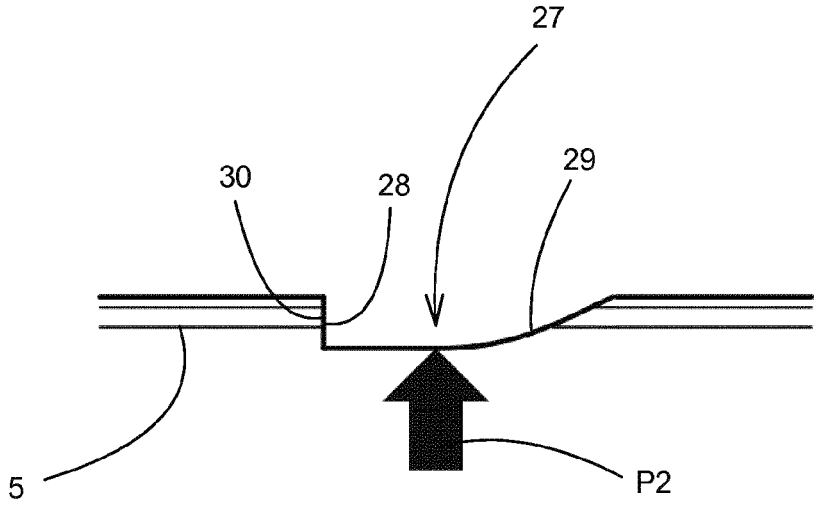
FIGS. 4A and 4B are schematic top plan views of the package shown in FIG. 2 prior to and after the removal of the hook-shaped element from the recess, respectively.
Figure 4B:
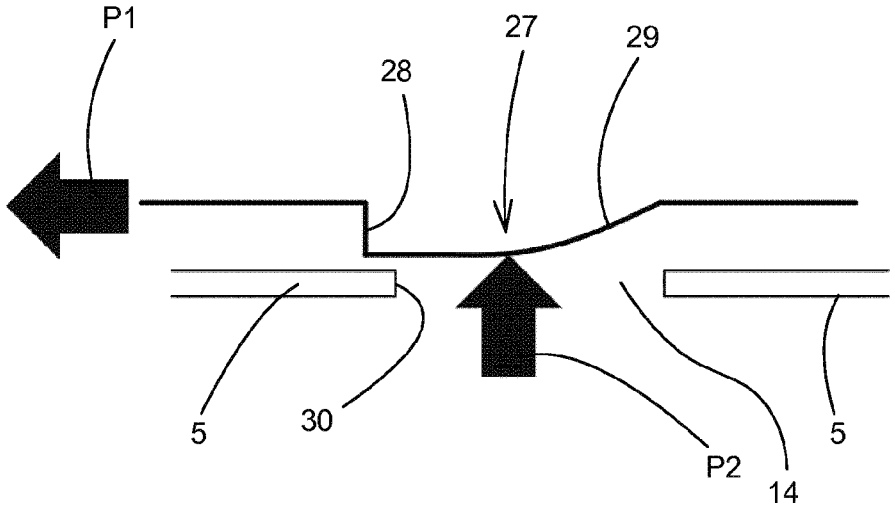
Figure 5:
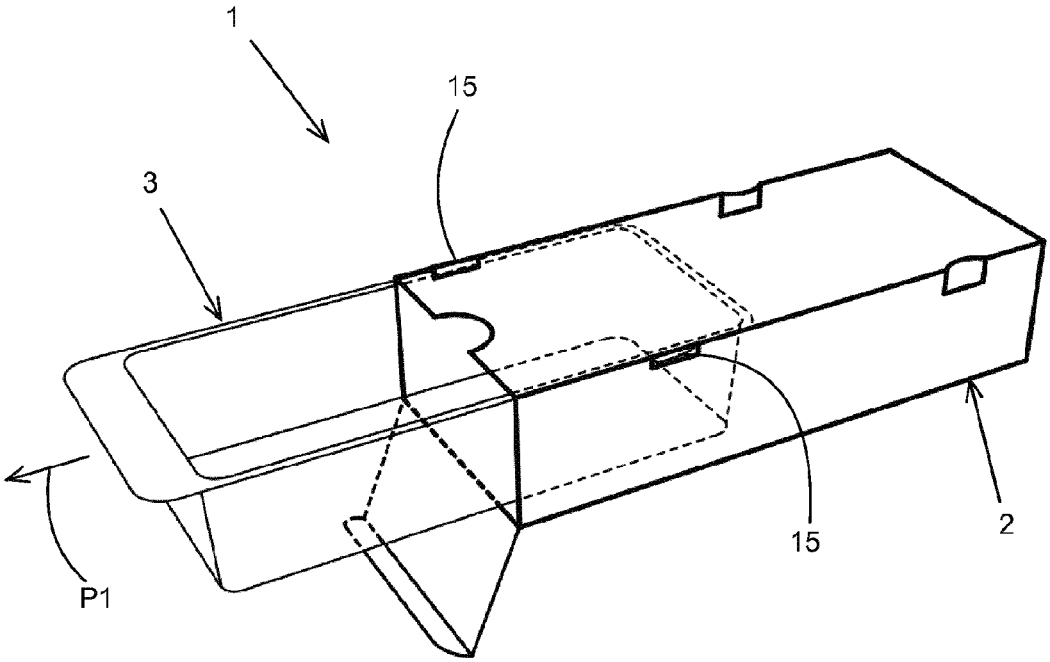
FIG. 5 is a perspective view of the package shown in FIG. 1 in a further open position.
Figure 6:
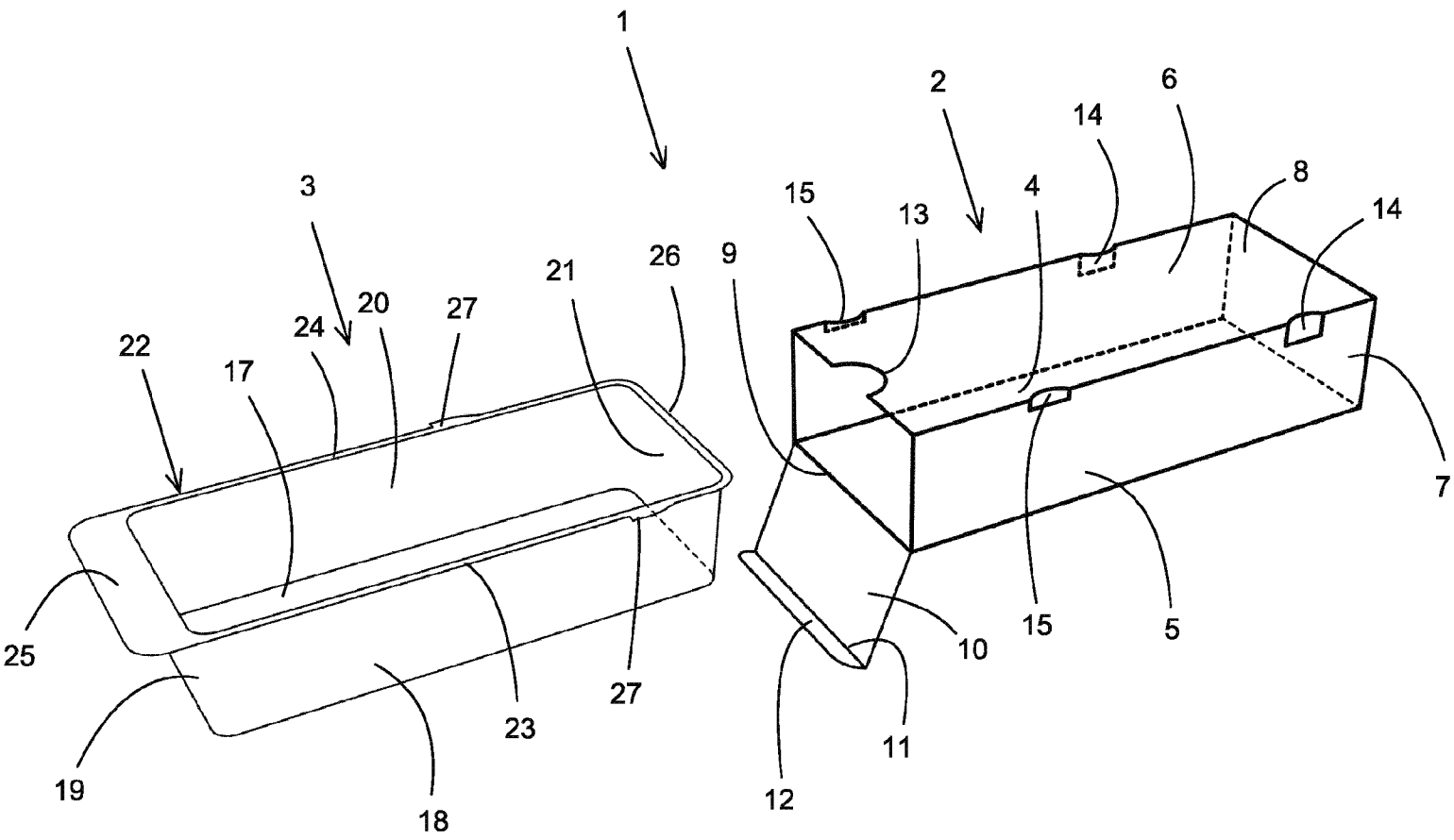
FIG. 6 is a perspective view of the package shown in FIG. 1 in a fully open position.

As is clearly shown in FIGS. 4A and 4B, the hook-shaped element 27 comprises a wall portion 28 extending transversely to the sliding direction indicated by the arrow P1 and a curved wall portion 29 connecting thereto. The wall portion 28 is located on a side of the hook-shaped element 27 that faces the wider part 25. The hook-shaped element 27 and the recesses 14, 15 are dimensioned so that the hook-shaped element 27 fits in the recesses 14, 15, with the wall portion 28 abutting against an edge 30 of the side wall 4, 5 that bounds the recess 14, 15 (see FIG. 4A).

The slide 3 is preferably made of a plastic material, such as PVC, ABS, PE, PET, PS and PP, to be deformed by means of a thermoforming process. After thermoforming of the slide 3 has taken place, the hook-shaped elements 27 are punched into the upper edge 22, with the desired dimensions of the parts 23, 24, 25, 26 being obtained by said the punching operation. The bottom wall 17, the side walls 18, 19, 20, 21 and the upper edge 22 are relatively thin, so that the parts 23, 24 of the upper edge 22 that are provided with the hook-shaped elements 27 can be moved toward each other against the spring force of the material of the slide 3.

The dimensions of the cardboard housing 2 can vary from, for example, a width of 21 to 151 mm, a height of 51 to 101 mm and a length of 51 to 301 mm. The wall thickness of the housing 2 can vary from 400 to 1000 micron, for example.

The dimensions of the slide 2 can vary from, for example, a width of 20 to 150 mm, a height of 50 to 100 mm and a length of 50 to 300 mm. The wall thickness of the slide 3 can vary from 200 to 1000 micron, for example.

Blister packs present in the slide 3 preferably have dimensions smaller than those of the bottom wall 17 of the slide 3. The draft angle of more than 90 degrees between the bottom wall 17 and the side walls 18-20 that is required for the thermoforming of the slide 3 has the advantage in this regard that the side walls 18, 20 are spaced further apart near the upper edge 22 than near the bottom wall 17. As a result, the side walls 18, 20 can be slightly moved toward each other near the upper side upon elastic deformation of the upper edge 22, without making contact with products present in the slide 3.

The operation of the package 1 is as follows.

In the closed position of the package 1 that is shown in FIG. 1, the slide 3 is fully enclosed within the housing 2, and the flap 10 is in the closed position. The slide 3 is now hidden from view and access to the products present therein, such as loose medicines or tablet blister packs, is not possible. In the closed position, the hook-shaped elements 27 of the slide 3 are positioned in the recesses 14 of the housing (see FIG. 4A).

Figure 2:
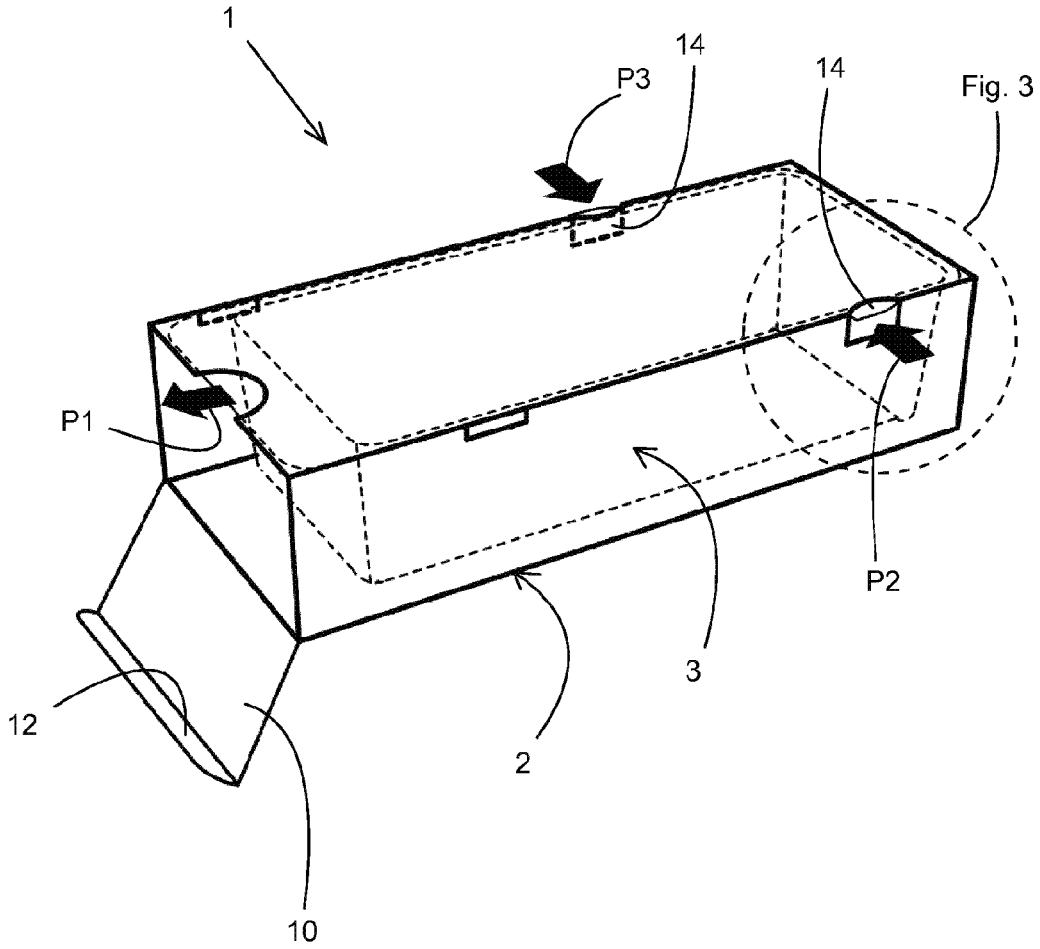
FIG. 2 is a perspective view of the package shown in FIG. 1 in a partially open position.
Figure 3:
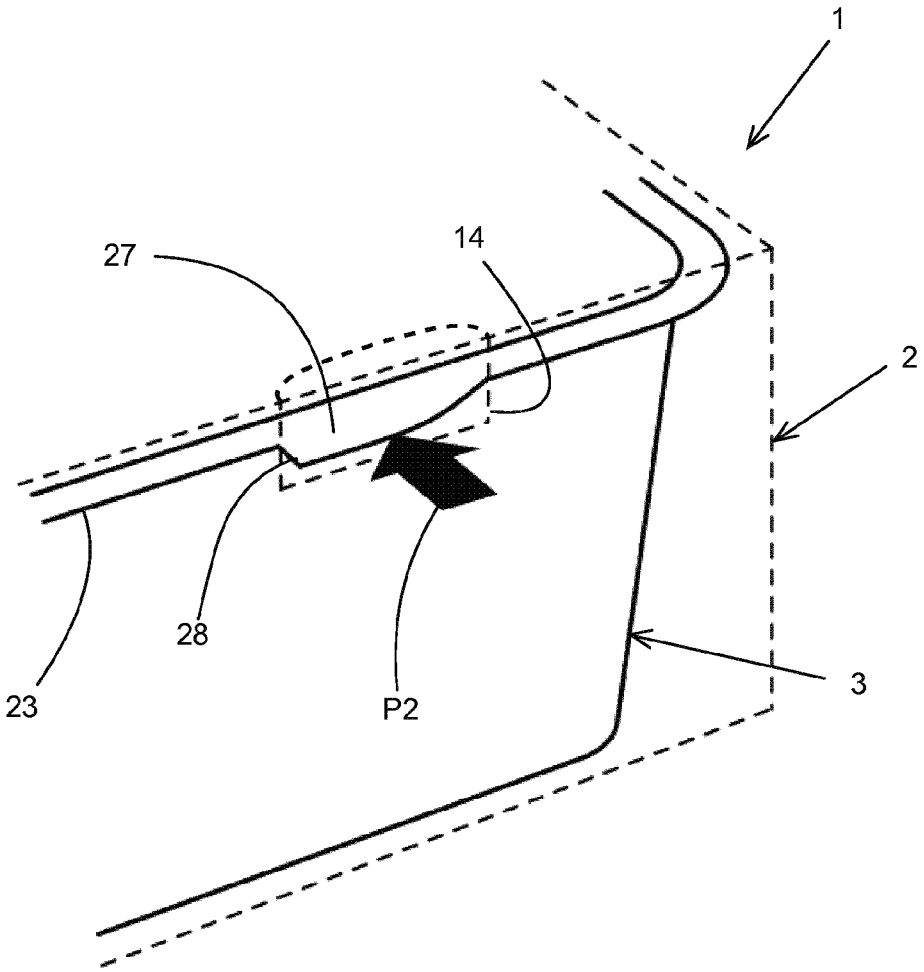
FIG. 3 is a perspective detail view of the package shown in FIG. 2.

When a user wishes to take products from the slide 3, the flap portion 12 is first pivoted about the pivot line 9 (see FIG. 2). Then the user presses on the hook-shaped elements 27 positioned in the staggered recesses 14 in the directions indicated by the arrows P2, P3 with two fingers, for example the thumb and the index finger. The directions indicated by the arrows P2, P3 extend transversely to the sliding direction indicated by the arrow P1. The fingers are thus positioned in the arcuate parts of the recesses 14 in the upper wall 8. The staggered hook-shaped elements are moved out of the recesses 14, in the directions indicated by the arrows P2, P3, against spring force and under elastic deformation of the side walls 18, 20 and the parts 23, 24, with the wall portions 28 moving clear of the side walls 5, 6 in question (see FIG. 4B). Using his other hand, the user then takes hold of the wider part 25 of the upper edge 22, which is freely accessible through the opening 13 of the housing 2, whereupon the user moves the slide 3 out of the housing, in the direction indicated by the arrow P1, to the position shown in FIG. 5. In this partially open position, the hook-shaped elements 27 move in the opposite directions of the arrows P2, P3 under the influence of the spring force of the side walls 18, 20 and the parts 23, 24, resulting in the hook-shaped elements 27 being positioned in the recesses 15. Further movement in the sliding direction indicated by the arrow P1 is thus prevented. The products (not shown) present in the slide 3 can now be removed from the slide 3. If a user wishes to remove the slide 3 from the housing 2 in its entirety, for example in order to dispose of the plastic slide 3 and the cardboard housing 2 separately, the user will depress the hook-shaped elements 27 positioned in the recesses 15 in the directions indicated by the arrows P2, P3 with two fingers, for example the thumb and the index finger. As a result, the staggered hook-shaped elements 27 will be moved out of the recesses 15 in the direction indicated by the arrows P2, P3 against spring force and under elastic deformation of the side walls 18, 20 and the parts 23, 24, with the wall portions 28 moving clear of the side walls 5, 6 in question. Using his other hand, the user will then take hold of the wider part 25 of the upper edge 22 and move the slide 3 out of the housing, in the direction indicated by the arrow P1, to the position shown in FIG. 6.

If a relatively young child undesirably attempts to open the package 1, it will presumably be able to open the flap 10. The child will then pull at the wider part 25 of the upper edge 22, which is freely accessible through the opening 13 of the housing 2. However, because the wall portions 28 of the hook-shaped elements 27 abut against the edge 30 of the side walls 4, 5 (see FIG. 4A), moving the slide 3 out of the housing 2 is prevented in a simple manner.

Figure 7:
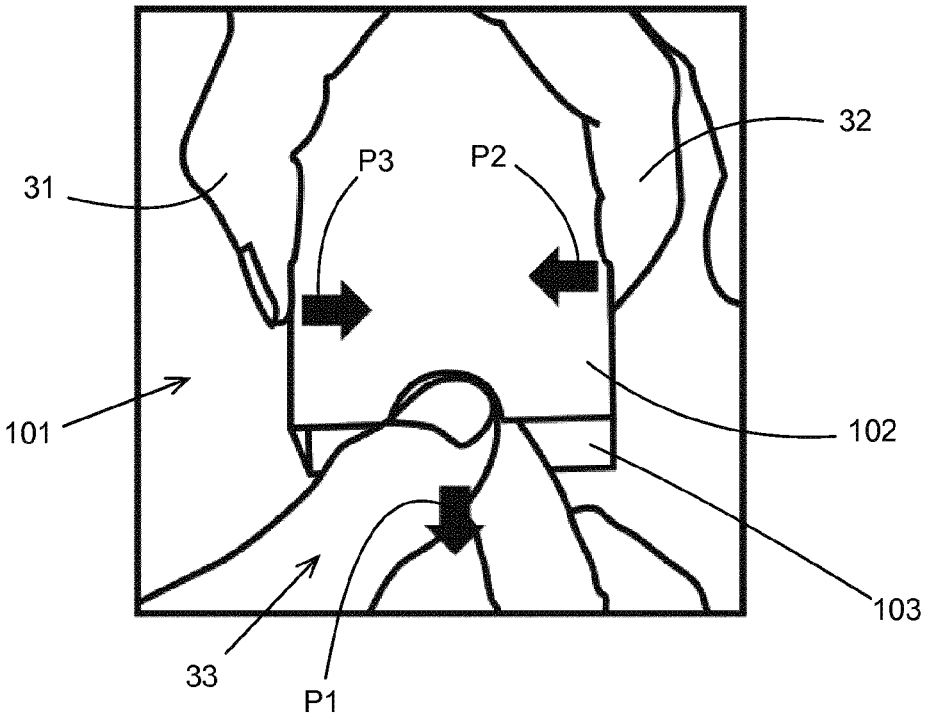
FIG. 7 is a perspective top plan view of a part of a second embodiment of a package according to the invention.

FIG. 7 schematically shows a second embodiment of a package 101 according to the invention, which is different from the package 1 shown in FIGS. 1-6 in that staggered recesses 14 are only provided at the front side. In this embodiment, too, the user will press on hook-shaped elements 27 positioned in the recesses 14 in the directions indicated by the arrows P2, P3 with two fingers, for example the thumb 31 and the index finger 32. The user will then take hold of the part of the upper edge that is freely accessible through the opening of the housing 102 with his other hand 33 and move the slide 103 out of the housing in the direction indicated by the arrow P1.

Figure 8:
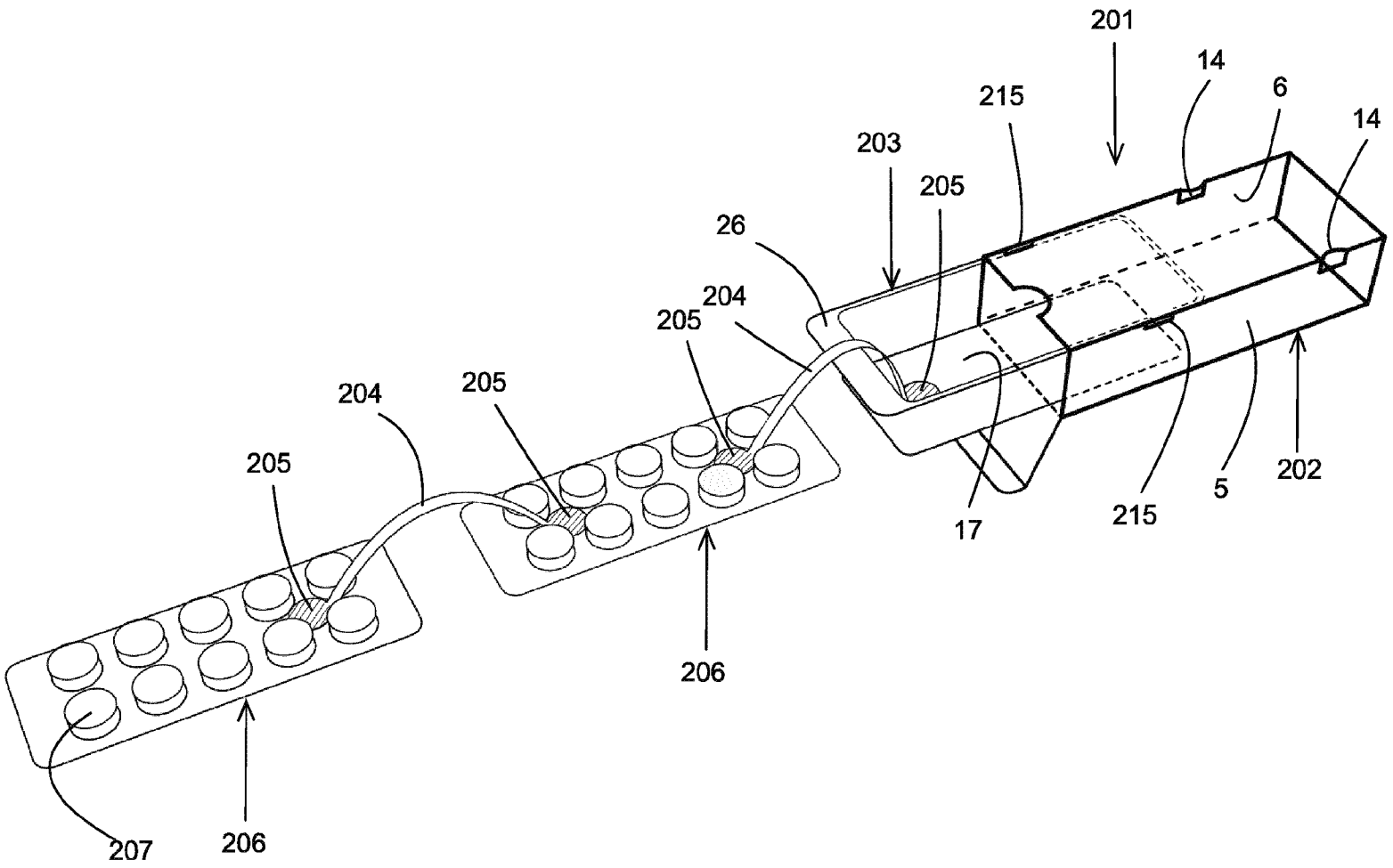
FIG. 8 is a perspective view of a third embodiment of a package according to the invention with folded-out blister packs.
Figure 9:
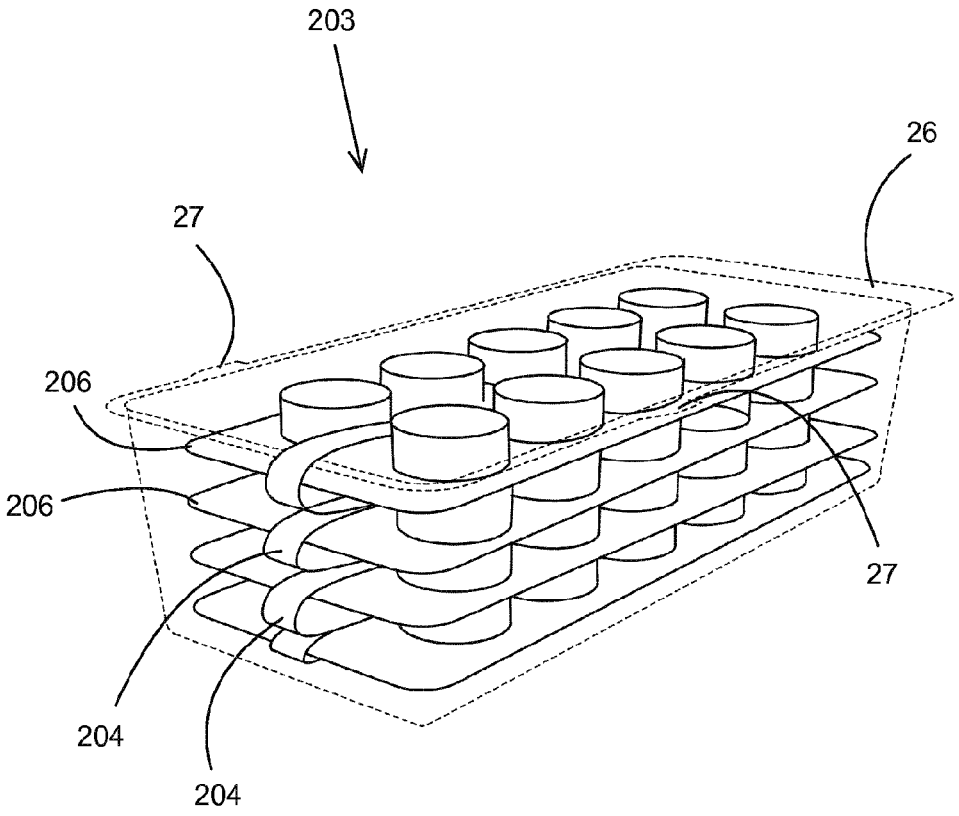
FIG. 9 is a perspective view of the slide of the package shown in FIG. 1 with folded-up blister packs.

FIGS. 8 and 9 show a third embodiment of a package 201 according to the invention, which is different from the package 1 shown in FIGS. 1-6, inter alia in that different recesses 215 are located at the front side of the housing 202. The recesses 215 are not provided in the upper wall 8 but only in the side walls 5, 6 and have a height which is just slightly greater than the thickness of the hook-shaped elements 27. As a result, the hook-shaped elements 27 engaging in the recesses 15 prevent the slide 203 from being moved out of the housing 202 in its entirety. Because of the relatively small dimensions of the recesses 215, it will be virtually impossible for a user to push the hook-shaped elements 27 out of the recesses 215.

The slide 203 of the package 201 is provided with a flexible strip 204, which is provided with a circular attachment part 205 at both ends. The flexible strip 205 is attached to the bottom wall 17 of the slide 203 via the circular attachment part 205, for example by being glued or ultrasonically bonded thereto. Another circular attachment part 205 of the flexible strip 204 is attached to a blister pack 206. Such blister packs 206, for example for tablets, are known per se; they are provided with a number of elevations 207, each of which contains a tablet. A cover layer (not shown) is present on a side remote from the elevation 207, which cover layer keeps the tablets in the elevations 207. The package 201 comprises a number of flexible strips 204 corresponding to the number of blister packs 206. The first flexible strip 204 connects a first blister pack 206 to the slide 203. The next flexible strip 204 connects the first blister pack 206 to a second blister pack 206, etc. The flexible strips 204 make it possible to stack the blister packs 206 one on top of the other, with the flexible strip 204 being partially positioned between two blister packs 206 disposed one on top of the other (see FIG. 9).

According to another possibility, a single elongated flexible strip extends from the slide 203 over all the blister packs 206 present in the slide 203.

Because the blister packs 206 are connected to each other and to the slide 203, a user will be able to remove a product, such as a tablet, from the blister pack 206, but he will not be able to remove an entire blister pack 206 from the package 201. This makes it impossible to store the blister pack 206 outside from the package 201.

The flexible strip 204 enables a user to place the blister pack 206 in practically any desired position with respect to the slide 203, making it easier to remove a tablet from the blister pack.

Figure 10:
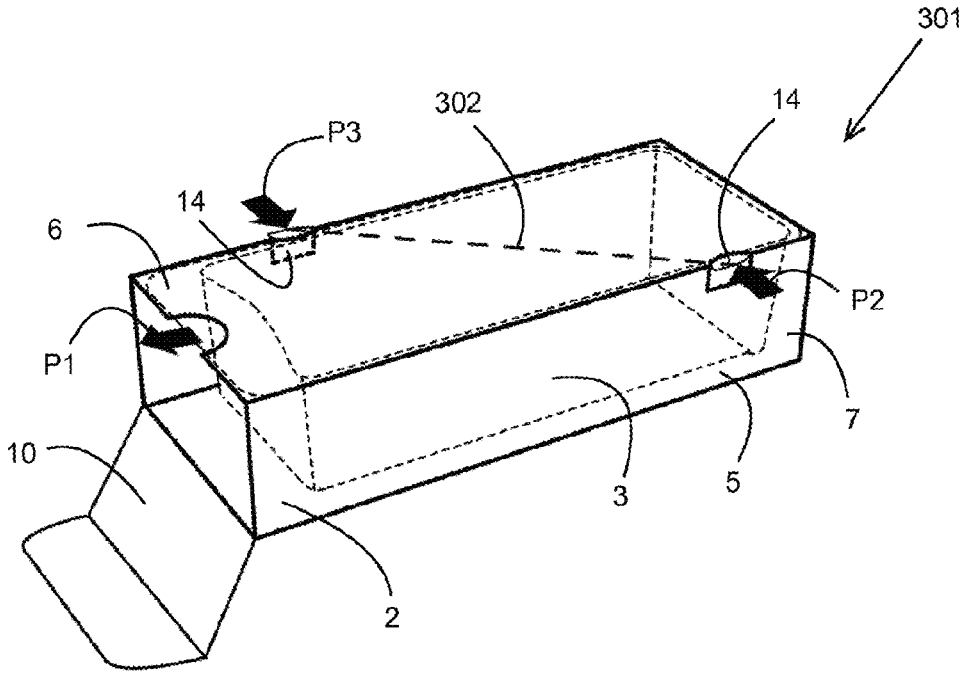
FIG. 10 is a perspective view of a fourth embodiment of a package according to the invention in a partially open position.
Figure 11:
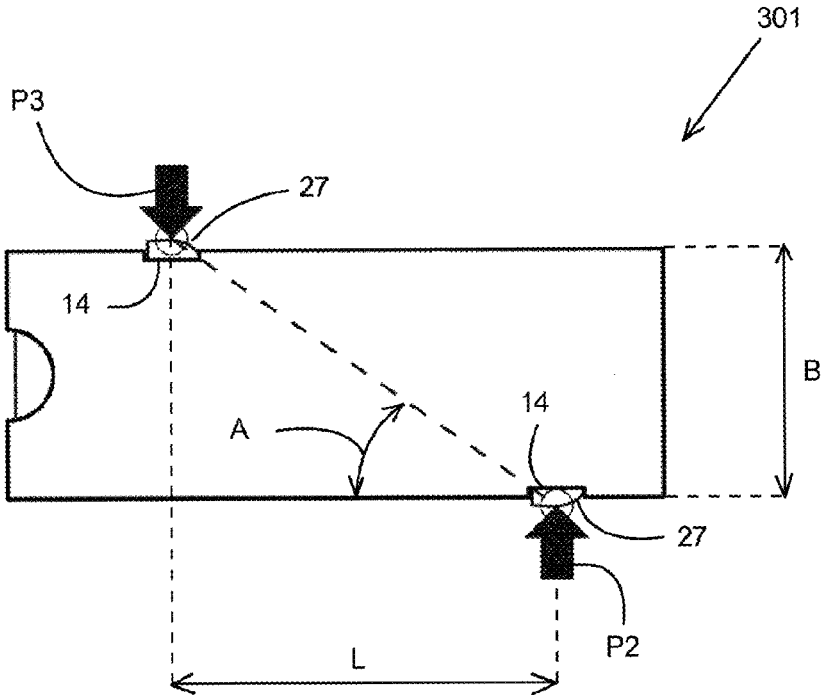
FIG. 11 is a top plan view of the package shown in FIG. 10.

FIGS. 10-14 show various views of a fourth embodiment of a package 301, which is different from the package 1 in that the first side wall 5 is only provided with a recess 14 located between the centre of the side wall 5 and the rear wall 7, and the second side wall 6 is only provided with a recess 14 located between the centre of the side wall 6 and the closable flap 10. The slide 3 is provided with two hook-shaped elements 27, which are located at the same relative position as the recesses 14, so that the hook-shaped elements 27 are positioned in the recesses 14 in the position of the slide 3 in the housing 2 that is shown in FIG. 10.

A diagonal line 302 is drawn between the staggered recesses. Said line is not present on the actual package 301 but is only shown by way of illustration of the invention. The diagonal line 302 between the staggered recesses 14 in the two side walls 5, 6 includes an angle A at most 60 degrees and at least 20 degrees with the side wall 5, 6. The staggered recesses 14 are spaced apart by a distance L of at least 60 mm and at most 120 mm in a direction parallel to the side walls 5, 6. When such dimensions are used, the width B of the package 301 will range between 35 mm and 120 mm, and the length of the diagonal line will range between 70 mm and 140 mm.

Figure 12:
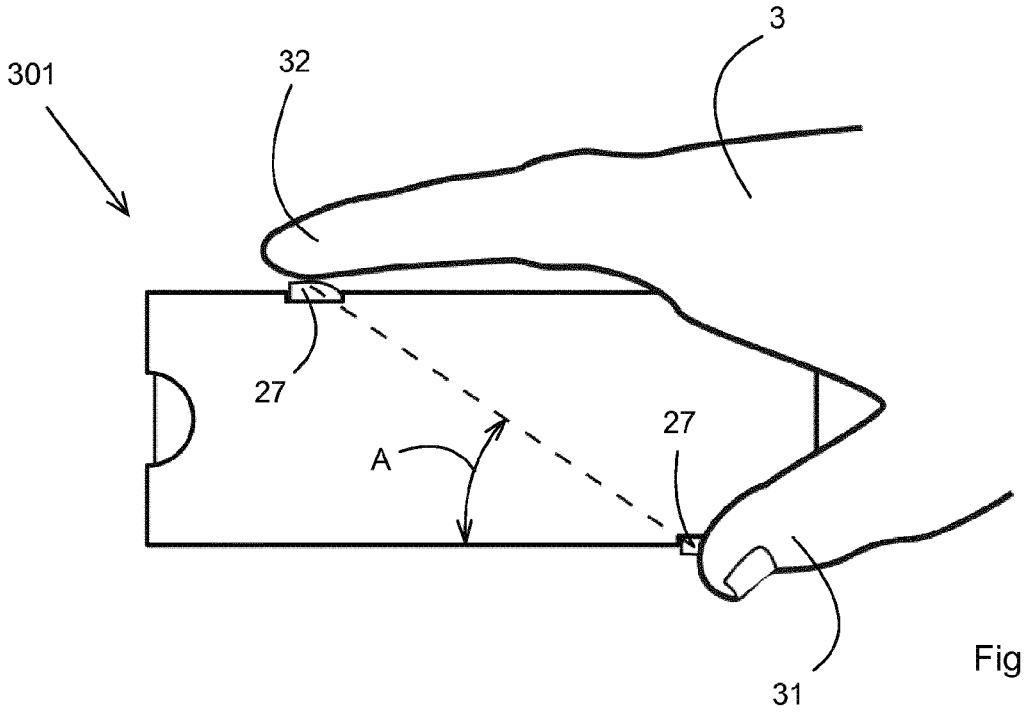
FIG. 12 shows the top plan view of FIG. 11 of the package shown in FIG. 10 with a hand of an adult.

FIG. 12 shows a hand 33 of an adult, who can easily depress the staggered hook-shaped elements 27 simultaneously in the directions indicated by the arrows P2 and P3 with his thumb 31 and index finger 32 for releasing the engagement between the slide 3 and the housing 2.

Figure 13:
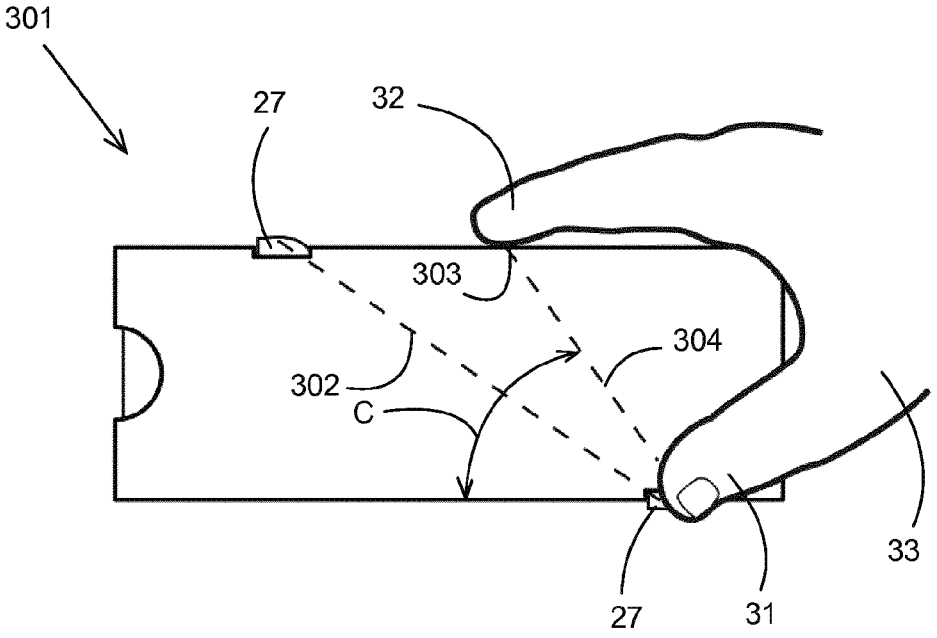
FIG. 13 shows the top plan view of FIG. 11 of the package shown in FIG. 10 with a hand of a small child.

FIG. 13 shows a small hand 33 of a young child of about four years old, who can depress the hook-shaped element 27 near the first wall 5 with his thumb 31 but is unable to simultaneously depress the other hook-shaped element 27 near the second wall 6 with his index finger 32 as well due to the small size of its hand. The index finger 32 touches the housing 2 at the location indicated by numeral 303. A diagonal line 304 between the hook-shaped element 37 near the first wall 5 and the location 303 includes an angle C of more than 60 degrees with the side walls 5, 6. The child will therefore be unable to unlock the slide 3.

Figure 14:
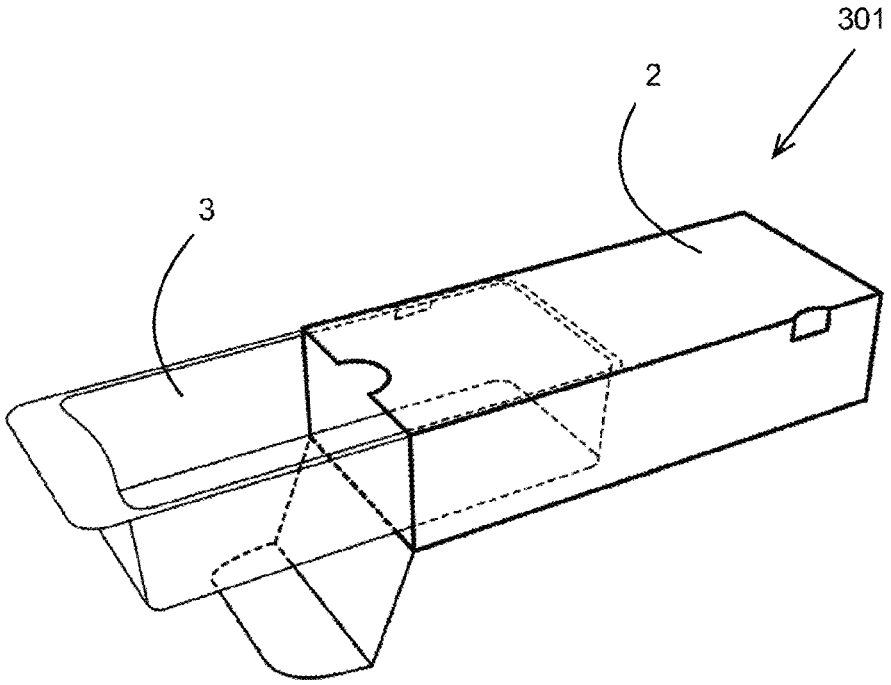
FIG. 14 is a perspective view of the package shown in FIG. 10 in a further open position.

FIG. 14 is a perspective view of the package 301 of FIG. 10 in a further open position, showing the slide 3 partially moved out of the housing 2.

Figure 15:
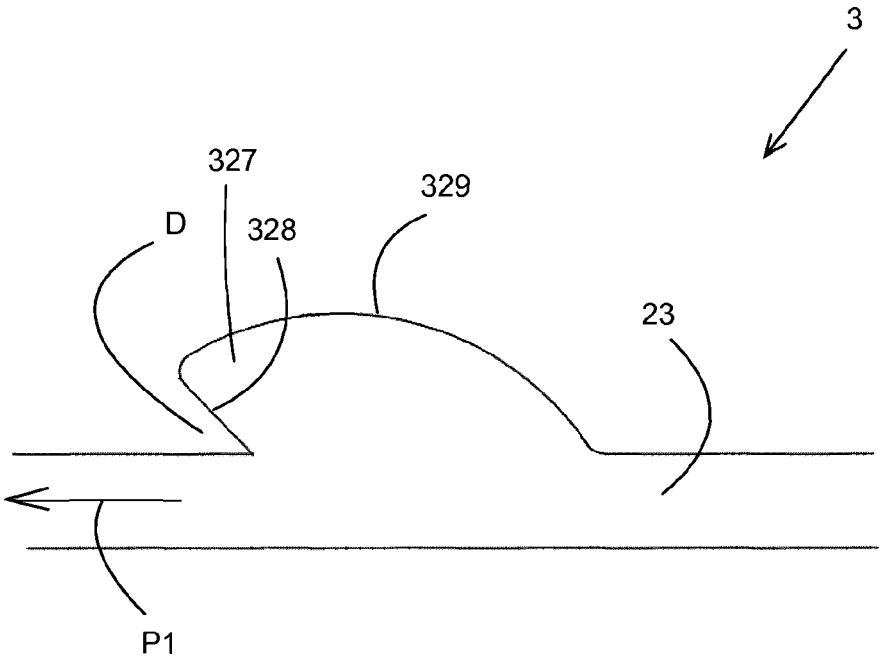
FIG. 15 is a top plan view of a part of the slide with another embodiment of the hook-shaped element.

FIG. 15 is a top plan view of a part 23 of the slide 3 with another embodiment of the hook-shaped element 327. As is clearly shown in FIG. 15, the hook-shaped element 327 comprises a wall portion 328 which extends at an acute angle D relative to the part 23 and the sliding direction indicated by the arrow P1, and a wall portion 329 which connects thereto. The sloping wall portion 328 gives the hook-shaped element 327 a barb-like configuration, so that the slide 3 must be slidably moved in the opposite direction of the arrow P1 before the hook-shaped element 327 can be pressed through the recess 14. This makes it impossible to pull at the slide 3 and subsequently depress the hook-shaped elements 321 one by one and remove them from the recesses 14.

Figure 16:
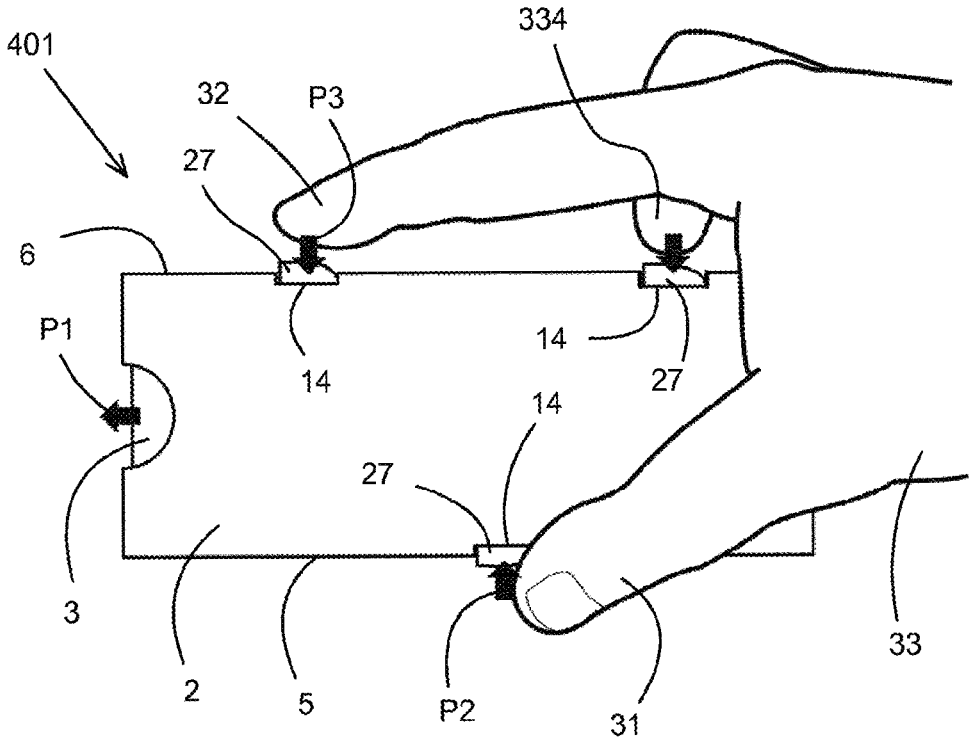
FIG. 16 is a top plan view showing a fifth embodiment of a package according to the invention provided with three recesses and three hook-shaped elements, as well as a hand of an adult.

FIG. 16 is a top plan view of a fifth embodiment of a package 401, which is different from the package 1 in that the first side wall 5 is only provided with a recess located near the centre and the second side wall 6 is provided with a recess 14 located between the centre and the rear wall 7 as well as with a recess 14 located between the centre and the closable flap 10. The slide 3 is provided with three hook-shaped elements 27, which are located at the same relative position as the recesses 14, so that the hook-shaped elements 27 are positioned in the recesses 14 in the position of the slide 3 in the housing 2 that is shown in FIG. 16.

The angles between diagonal lines between the recess 14 in the first side wall 5 on the one hand and the recesses 14 in the side wall 6 on the other hand are less critical in this embodiment than in an embodiment in which only two recesses 14 and two hook-shaped elements 27 are used. To move the slide 3 out of the housing 2, an adult can depress the hook-shaped element 27 in the recess 14 in the first side wall 5 with his thumb 31 and simultaneously depress the hook-shaped element 27 near the closable flap 10 with his index finger 32 and the hook-shaped element 27 near the rear wall 7 with his middle finger 334. Such an operation is virtually impossible to carry out for a child of about four years old in view of its limited motor skills and the size of its hand.

According to another possibility, the upper edge only extends over part of the side walls.

It is also possible to use different materials for the slide and the housing, such as plastics suitable for thermoforming or injection-moulding, cardboard, especially tear-resistant cardboard, or a metal such as aluminium.

It is also possible to provide the slide with two pairs of hook-shaped elements and to provide the housing with a single pair of recesses near the front side of the housing in order to define a closed position and a partially open position.

It is also possible to provide the slide with a single pair of hook-shaped elements and to provide the housing with a single pair of recesses so as to define only a closed position in the package.

According to another possibility, the recesses are hidden from view by wall portions extending over the recesses. Said wall portions must be flexible so that the hook-shaped elements can be pressed out of the recesses located behind the wall portions as a result of pressure being exerted on said wall portions.

The hook-shaped element may also extend from the flanged-shaped upper edge over part of the side wall. The recess must be correspondingly configured in that case. In this way a larger hook-shaped element is obtained.

LIST OF NUMERALS

1 package
2 housing
3 slide
4 bottom side
5 side wall
6 side wall
7 rear wall
8 upper wall
9 pivot line
10 flap
11 pivot line
12 flap portion
13 opening
14 recess
15 recess
17 bottom wall
18 side wall
19 side wall
20 side wall
21 side wall
22 upper edge
23 part
24 part
25 part
26 part
27 hook-shaped element
28 wall portion
29 wall portion
30 edge
31 thumb
32 index finger
33 hand
101 package
102 housing
103 slide
201 package
202 housing
203 slide
204 strip
205 circular attachment part
206 blister pack
207 elevations
215 recesses
301 package
302 diagonal line
327 hook-shaped element
328 wall portion
329 wall portion
401 package
334 middle finger
A angle
B width
C angle
D angle
L distance
P1 arrow
P2 arrow
P3 arrow

The invention claimed is:

1. A package comprising:

a housing and a slide which is slidably accommodated in the housing in a sliding direction ($P_1$) and first and second projections connected to the slide, which slide comprises a bottom wall, first and second side walls connected to the bottom wall, each of the first and second side walls comprising:

a flange-shaped upper edge, wherein each of the flange-shaped upper edges is spaced from the bottom wall, which housing comprises a first housing side wall and a second housing side wall, and the first housing side wall comprises a first recess and the second housing side wall comprises a second recess, wherein the first and second recesses respectively receive the first and second projections for at least locking the slide in position in the housing, wherein each of the first and second projections can be moved out of the respective first and second recess it is received in against a spring force of the flange-shaped upper edge, after which the slide can be moved in the sliding direction ($P_1$) in the housing, wherein each flange-shaped upper edge comprises a part that extends parallel to the sliding direction ($P_1$), wherein each part is provided with one of the first and second projections and each of the first and second projections comprises at least one hook-shaped element, wherein the first recess and the at least one hook-shaped element of the first projection received in the first recess are staggered, as seen in the sliding direction ($P_1$), relative to the second recess and the at least one hook-shaped element of the second projection received in the second recess, wherein each of the at least one hook-shaped elements can be moved out of the first and second recesses against the spring force of the flange-shaped upper edge.

2. A package according to claim 1, wherein the first recess and the second recess are staggered such that a diagonal line drawn between the first recess and the second recess forms an angle of at most 60 degrees with one of the first and second housing side walls.

3. A package according to claim 1, wherein the first recess and the second recess are spaced a distance of at least 60 mm apart, seen in a direction parallel to one of the first and second housing side walls.

4. A package according to claim 1, wherein each at least one hook-shaped element has a barb.

5. A package according to claim 1, further comprising a third recess in the second housing side wall, wherein the first recess is staggered relative to the second recess, whilst an additional projection is connected to the slide and the additional projection comprises a hook-shaped element, wherein the additional projection is received in the third recess, and the first and second projections and the additional projection can be moved out of the respective first, second and third recess simultaneously against the spring force of the flange-shaped upper edge.

6. A package according to claim 1, wherein for each of the first and second side walls, the at least one hook-shaped element lies in the same plane as the part of the flange-shaped upper edge that extends parallel to the sliding direction ($P_1$).

7. A package according to claim 1, wherein each of the first and second housing side walls of the housing is provided with at least two spaced-apart recesses.

8. A package according to claim 1, wherein each of the first and second recesses is partially located in an upper wall of the housing.

9. A package according to claim 1, wherein the housing comprises an upper wall which is provided with an opening at a front side, seen in the sliding direction ($P_1$), via which opening access can be gained to a part of a flange-shaped upper edge of the slide that extends transversely to the sliding direction ($P_1$).

10. A package according to claim 1, wherein the housing is provided with a closable flap.

11. A package according to claim 1, wherein the housing is closed at a rear side, seen in the sliding direction ($P_1$).

12. A package according to claim 1, wherein the slide is made of plastic material, using a thermoforming process.

13. A package according to claim 1, wherein the housing is made of cardboard.

14. A slide suitable for a package that includes a housing, the slide comprises a bottom wall, respective first and second side walls connected to the bottom wall, and each of the first and second side walls comprises a flange-shaped upper edge spaced from the bottom wall, wherein each of the flange-shaped upper edges comprises a part that extends parallel to a sliding direction ($P_1$) of the slide, wherein each part is provided with at least one hook-shaped element, wherein the at least one hook-shaped element located at the first side wall is staggered, as seen in the sliding direction, relative to the at least one hook-shaped element located at the second side wall.

15. A housing suitable for a package that includes a slide, the housing comprises recesses, in which at least one projection connected to a slide can be positioned for at least locking the slide in position in the housing, wherein said housing comprises respective first and second housing side walls, each of the first and second housing side walls being provided with at least one of the recesses, wherein the at least one of the recesses located at the first housing side wall is staggered in a sliding direction ($P_1$) of the slide, relative to the at least one of the recesses located at the second housing side wall.

* * * * *